US007721453B1

(12) United States Patent
Young

(10) Patent No.: US 7,721,453 B1
(45) Date of Patent: May 25, 2010

(54) CALIBRATED ARCHERY BOW SIGHT

(76) Inventor: Danny L. Young, 10885 Alvaton Rd., Alvaton, KY (US) 42122

( * ) Notice: Subject to any disclaimer, the term of this patent is extended or adjusted under 35 U.S.C. 154(b) by 75 days.

(21) Appl. No.: 12/258,795

(22) Filed: Oct. 27, 2008

Related U.S. Application Data

(60) Provisional application No. 60/982,779, filed on Oct. 26, 2007.

(51) Int. Cl.
*F41G 1/467* (2006.01)

(52) U.S. Cl. ..... 33/265; 124/87

(58) Field of Classification Search ..... 33/265
See application file for complete search history.

(56) References Cited

U.S. PATENT DOCUMENTS

| | | | | | |
|---|---|---|---|---|---|
| 3,337,960 | A | | 8/1967 | Paul et al. | |
| 3,487,548 | A | | 1/1970 | Freydenlund | |
| 3,674,002 | A | | 7/1972 | Diamond, Sr. | |
| 4,178,693 | A | * | 12/1979 | Smith | 33/265 |
| 4,215,484 | A | * | 8/1980 | Lauffenburger | 33/265 |
| 4,224,741 | A | | 9/1980 | Perry | |
| 4,541,179 | A | | 9/1985 | Closson | |
| 5,001,837 | A | | 3/1991 | Bray | |
| 5,359,780 | A | | 11/1994 | Dallaire | |
| 5,442,862 | A | | 8/1995 | Newbold et al. | |
| 5,511,317 | A | | 4/1996 | Allen | |
| 5,524,351 | A | | 6/1996 | Pinson et al. | |
| 5,651,185 | A | | 7/1997 | Vanderheyden et al. | |
| 5,920,996 | A | | 7/1999 | Hurckman et al. | |
| 5,975,069 | A | | 11/1999 | Hamm et al. | |
| 6,061,919 | A | * | 5/2000 | Reichert | 33/265 |
| 6,079,111 | A | | 6/2000 | Williams et al. | |
| 6,505,407 | B2 | | 1/2003 | Savage | |
| 6,701,632 | B2 | | 3/2004 | Henry | |
| 6,796,039 | B2 | | 9/2004 | Walbrink | |
| 6,868,614 | B2 | * | 3/2005 | Floied et al. | 33/265 |
| 2002/0112358 | A1 | * | 8/2002 | Savage | 33/265 |
| 2003/0136012 | A1 | | 7/2003 | Walbrink | |
| 2004/0107587 | A1 | * | 6/2004 | Floied et al. | 33/265 |

* cited by examiner

*Primary Examiner*—G. Bradley Bennett
(74) *Attorney, Agent, or Firm*—Laura M. Hagan

(57) ABSTRACT

The current invention relates to the need in the art for a bow sighting device that provides accuracy with the versatility that allows the sighting device to be readily transferred to any bow and fully calibrated using minimal sight in distances. From two sight-in yardages, the current invention extrapolates the remaining yardages on a visible scale essentially filling in the gaps using known mathematical principles of trajectory. Vertically arced displacement of a bow sight used in conjunction with the current invention is capable of performing this desirable function on any bow while allowing the archer to manually select a desired range from full draw.

5 Claims, 5 Drawing Sheets

CALIBRATED ARCHERY BOW SIGHT

This application claims priority to Provisional Application 60/982,879 filed with the United States Patent and Trademark Office on Oct. 26, 2007.

BACKGROUND OF THE INVENTION

In the field of archery, target sights have become as important as the bow itself. Conventional bow sights may include a number of sight pins that are manually set by the archer to sight in the arrow. Sighting requires the archer to make repeated releases toward a target located at a predetermined distance while making fine adjustments to the corresponding sight pin. This process is repeated for each desired distance and is known by archers to become cumbersome and time consuming, particularly when sighting multiple bows. Although providing a method for greater accuracy, the presence of multiple sight pins obscures the view of the target and requires the archer to remember the value of each pin while estimating when targets are located between the sighted values.

Efforts have been made to develop archery sights having a single pin capable of vertical adjustments to mimic the theory of multiple sight pins. However, these sights require the same process of fine adjustments for multiple sighting distances repeated for each bow. Like the multiple-pin sights, the archer is required to use two hands to make vertical adjustments to the single sight pin while remembering the scaled setting that applies to each predetermined distance. Therefore, the need for marking each pre-calibrated distance offers little to address the time-expense issue that is much needed in the art.

More recently in the art, moveable-pin sights offer the archer the ability to sight in an arrow using a graduated scale, whereby the vertical positioning of a single sight pin corresponds to a yardage scaled tape prepared by the archer. As known in the art, bow speed impacts the required trajectory necessary to for the bow to travel to the target. Due to this mathematical principle, greater adjustments in the angle of trajectory are required, when attempting to hit a target with a slower bow. The advantage of a real world scale removes the guesswork necessary by the archer; however, each tape used is sighted for a specific bow speed and arrow. As a result the moveable-site cannot be used on multiple bows without creating multiple, removable, scaled tapes.

SUMMARY OF THE INVENTION

The current invention fulfills a much needed advance in the art of archery bow sights comprising the manual translation about a vertical arc while in full-draw with a permanent real-world scale disposed on a calibrated range dial. Requiring only two sight-in distances, the presence of a real-world scale provides a visual indication of subsequent calibrated yardage distances, alleviating the time consuming process currently required to effectively sight-in a bow. Using known mathematical principles of trajectory, a fully scaled measurements ranging from distances from ten to one-hundred yards are available to the archer after using the dual sighting process of the current invention. To achieve this, a sliding sight arm allows adjustments to the bow sight to distances closer or further away from the archer's visual perspective to effectively increase or decrease the vertically arced displacement of the sight for ready adaptability to any bow speed. In an alternative embodiment, the device can be outfitted with reference marks showing the correct projected and vertical distance of the sight allowing the device to be transferred to previously sighted bows to provide an accurate sight-in starting location or even eliminating the need to repeat the sighting-in process all together.

The twenty-yard setting of the present invention is visually indicated to the archer on a graduated wheel located in the visual field when in full-draw. In this location, the sliding sight arm on which a standard bow sight is seated will always land in a position that is perpendicular to the bow when held in proper full draw position by the archer. In this position, fine adjustments to the vertical positions of the bow sight are made through a progression of multiple releases until the twenty yard distance is sighted in for the bow speed in use. An adjustment lever having a vertical indentation, disposed in a location easily accessibly to the archer's index finger of the bow arm while in full draw, is pulled toward the archer until a second sight in position greater than the initial sight in position is indicated on the graduated wheel, typically forty yards although larger alternative distances are acceptable. At the second sight-in yardage, adjustments to the sliding sight arm are made during the sighting in process while the vertical adjustments to the bow sight are avoided.

The vertically arced displacement of the sight using the vertical adjustment plate is contingent of the placement of the archery sights about the sliding sight arm. The distance in which the bow sight is seated on the retractable arm allows the sight to have a smaller or larger vertically arced displacement in relation to the archer's line of sight. It is known by those skilled in the art that adjustments to the angle or trajectory depend on the speed on the bow in use. For instance, a slower bow requires a greater adjustment to the angle of trajectory between target distances, whereas a faster bow requires finer adjustments to the angle of trajectory. With this principle in mind, the current invention incorporates the use of sliding sight arm to vary the path length of a vertically displaced arc using known mathematical principles of trajectory and its relationship to speed.

DETAILED DESCRIPTION OF THE INVENTION

Figure 1:
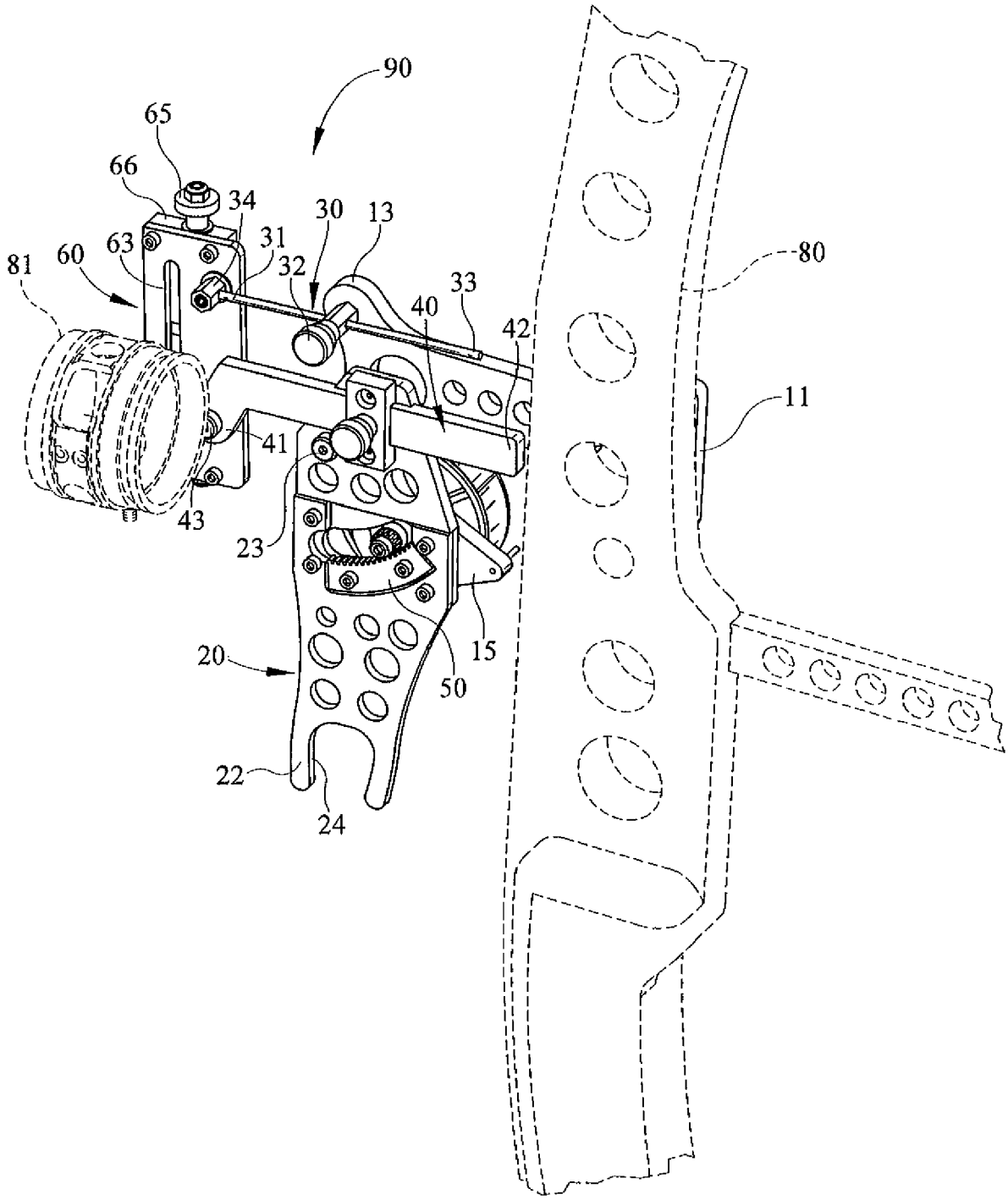
FIG. 1 is an angled perspective view of the calibrated archery bow sight.

In the following description, numerous specific details and options of the present invention are set forth in order to provide a more thorough understanding of the claimed invention. It will be appreciated, by one skilled in the art that the Calibrated Archery Bow Sight of the present disclosure may be practiced without such specific details or optional components and that such description are merely for convenience and as such solely selected for the purpose of illustrating the invention. Reference to the figures showing embodiments of the present invention are made to describe the invention and do not limit the scope of the disclosure herein. A calibrated archery bow sight in accordance with the following disclosure is illustrated in the drawings and generally designated 90.

Figure 3:
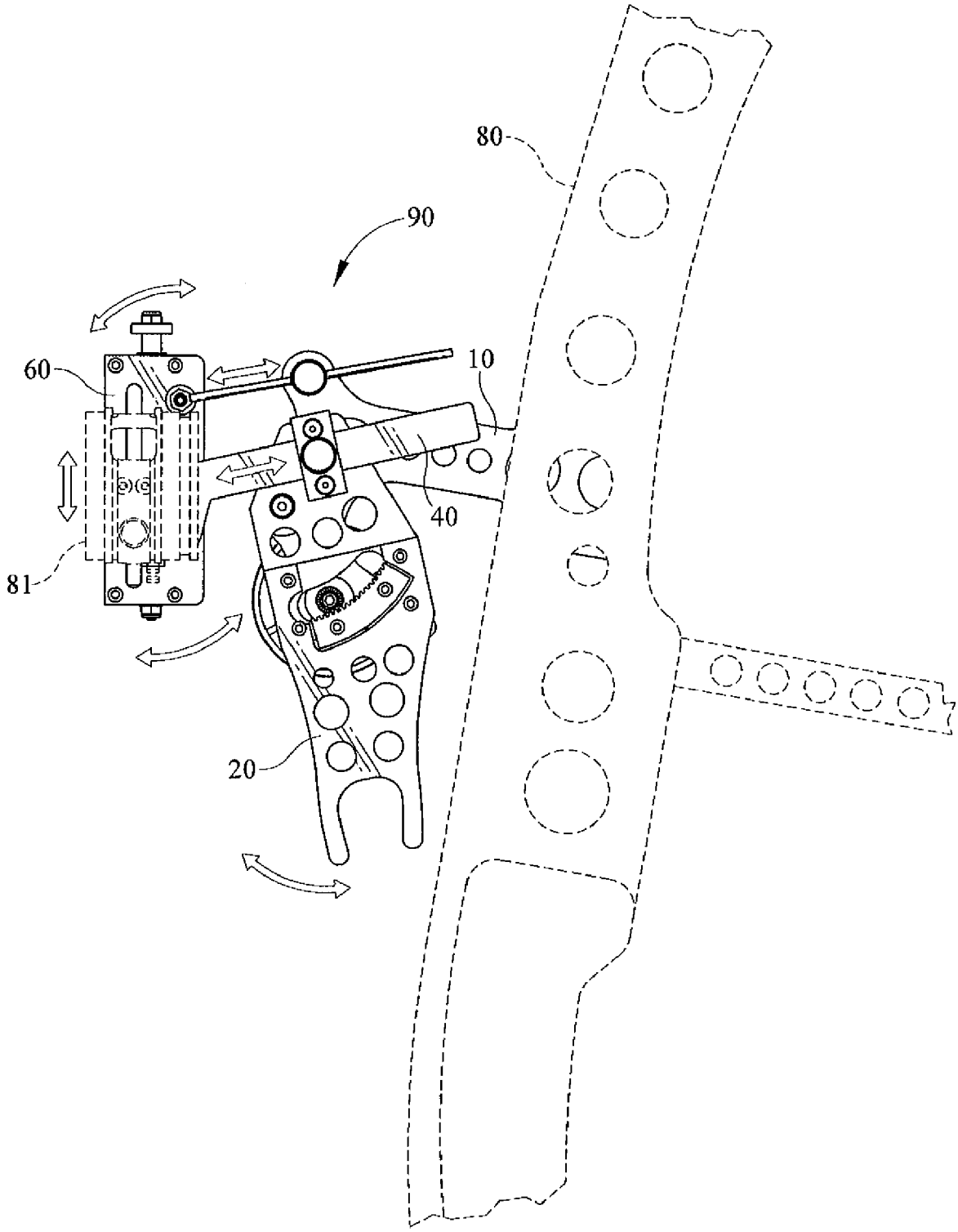
FIG. 3 is a side view of the calibrated archery bow sight detailing the movements defined in the current disclosure.
Figure 4:
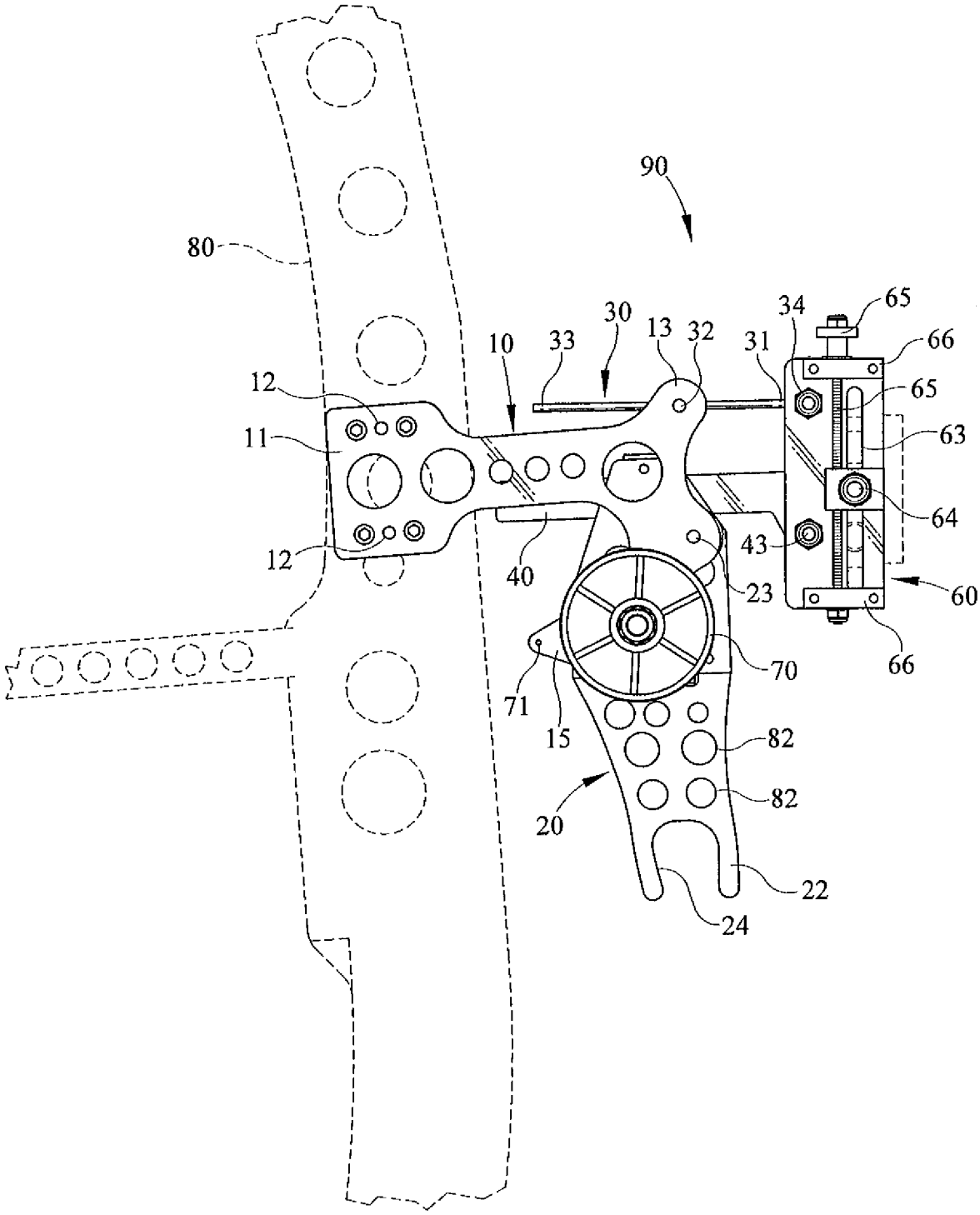
FIG. 4 is a side view of the calibrated archery bow sight
Figure 5:
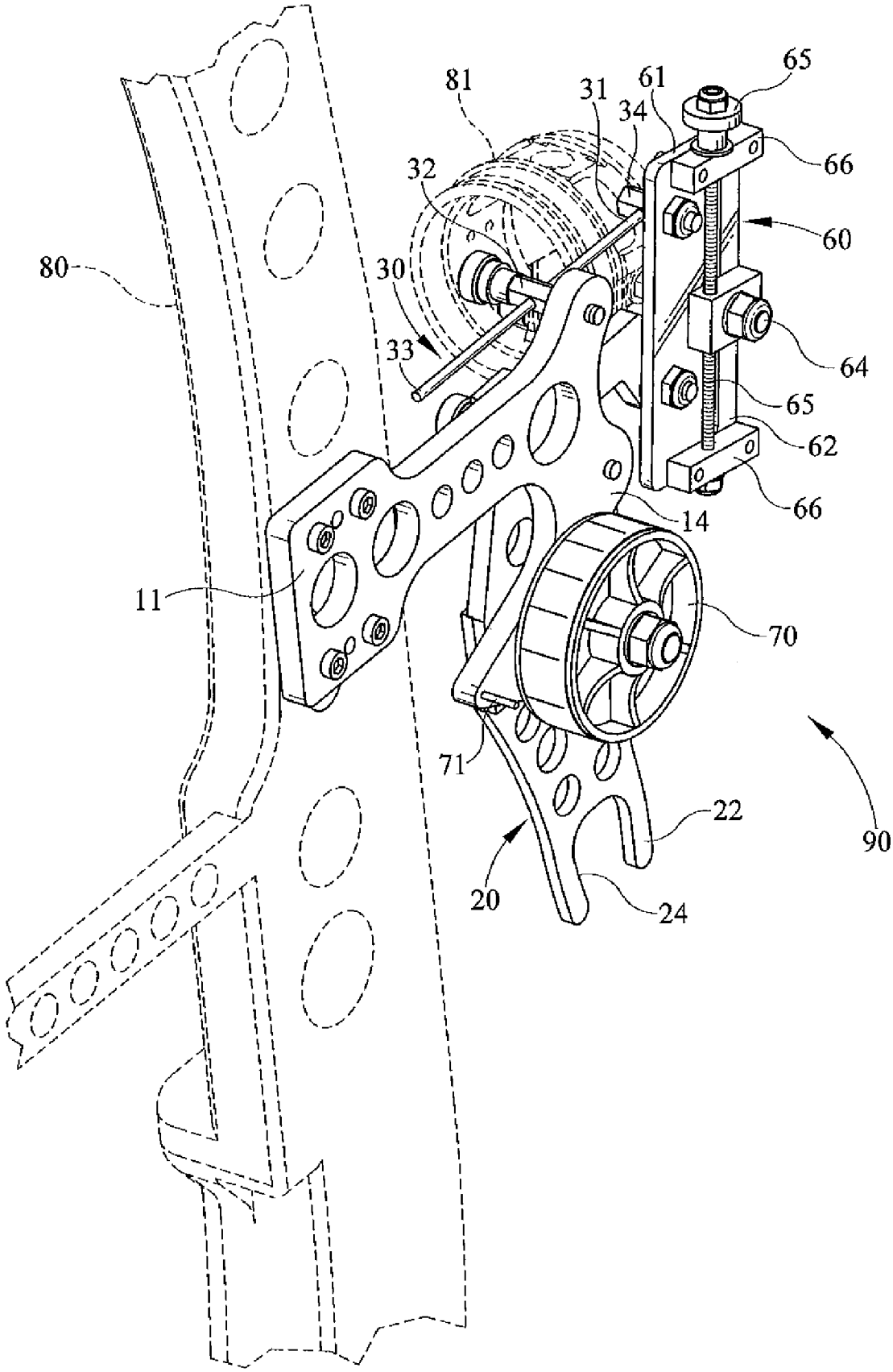
FIG. 5 is a perspective view of the calibrated archery bow sight

As shown in FIGS. 4 and 5, the invention 90 is secured with standard fasteners to an archery bow 80 in the general area of the bow riser. The components of the invention 90 include a mounting bracket 10, an adjustment lever 20 capable of moving in a curvilinear path, shown in FIG. 3, a sliding sight stabilizer rod 30 capable of sliding adjustments, shown in FIG. 3, a sliding sight arm 40 capable of sliding adjustments, shown in FIG. 3, curved rack gear 50 and pinion 51, a sight plate 60 capable of rotational adjustment, shown in FIG. 3, a sight mount with securing means 64 capable of vertical adjustments, also shown in FIG. 3 and a calibrated range dial 70 with an index pin 71.

With reference to included FIGUREs, the construction of the invention is comprised of the following. The mounting bracket 10 having a mounting end 11 including a plurality of mounting apertures 12 is affixed to the archery bow 80 using standard fasteners as shown in FIGS. 4 and 5. An upper projection 13 of the mounting bracket 10 contains a second pivotal connection 32 with the adjustable sight stabilizer rod 30 disposed in a sliding relation therein. The sight stabilizer bar 30, having a pivotal end 31 and an unsecured end 33, is capable of longitudinal sliding adjustments within the second pivotal connection 32 from the pivotal end 31 to the unsecured end 33 and held in the desired location by the second pivotal connection 32. A sight plate 60, having an upper end 61 and a lower end 62 is secured to the pivotal end 31 of the sight stabilizer rod 30 by a third pivotal connection 34.

Figure 2:
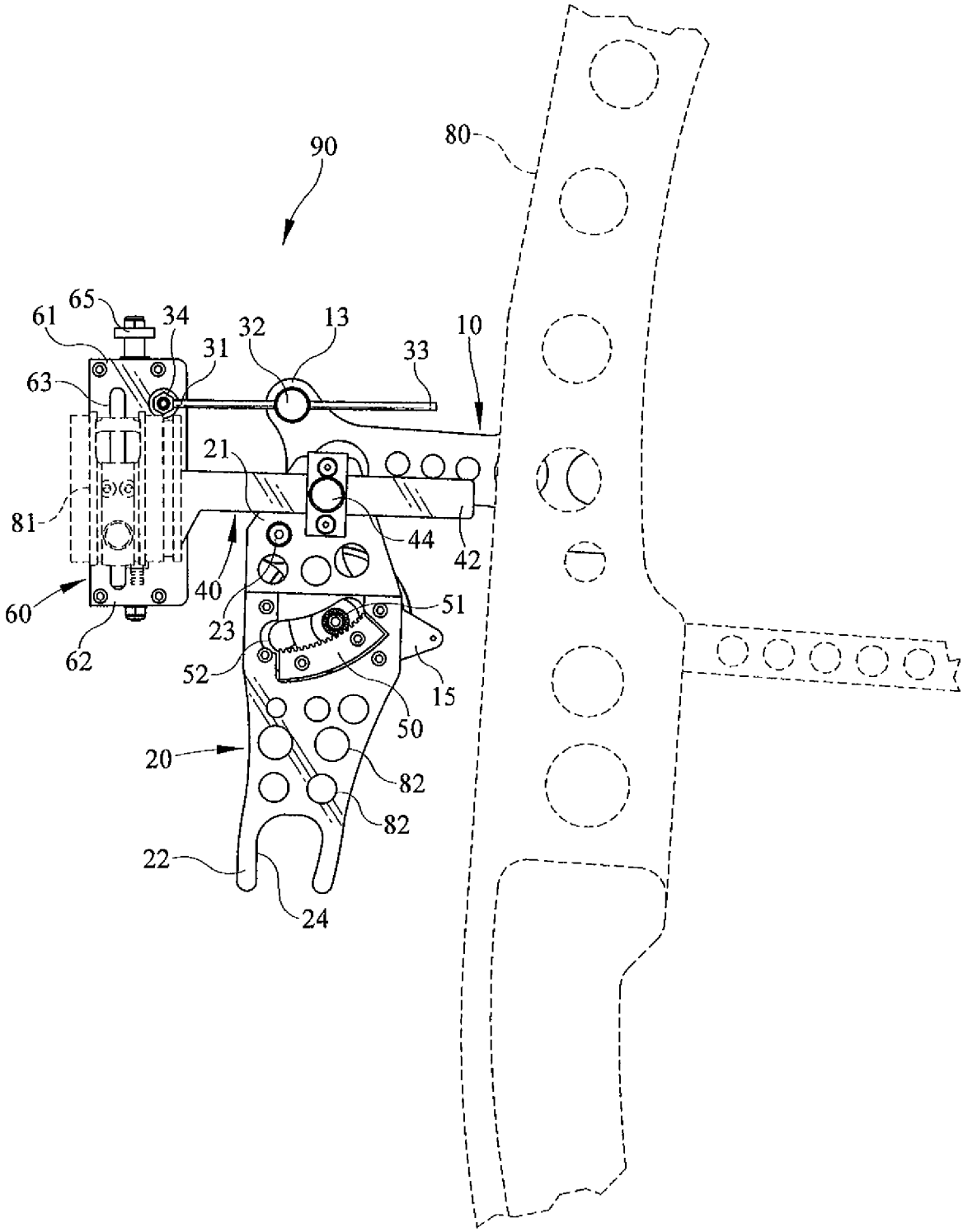
FIG. 2 is a side view of the calibrated archery bow sight.

A lower curved projection 14 of the mounting bracket 10 having a trailing end projection tip 15 contains a first pivotal connection 23 rotatably coupling the adjustment lever 20, having a pivotal end 20 and a translational end 22, to the lower curved projection 14 at the pivotal end 20, as shown in FIGS. 4 and 5. As shown in FIG. 5, a calibrated range dial 70 is disposed between the lower curved projection 14 and the trailing end projection tip 15. The calibrated range dial 70 is secured with a pinion gear 51 held within a pinion clearance aperture 52 containing a curved rack gear 50 disposed within the adjustment lever 20, as shown in FIG. 2. The rotational motion of the calibrated range dial 70 moving in conjunction with the pinion gear 51 as it rotates about the arc of the curved rack gear 50 in response to translational movement of the adjustment lever 20. An index pin 71 disposed on the trailing end projection tip 15 indicating the set range of the calibrated range dial 71 by visual inspection of the archer.

The translational end 22 of the adjustment lever 20 contains a vertical indentation 24, as shown in FIG. 2, to allow curvilinear movement of the adjustment lever 20 by applying tactile force from within the vertical indentation 24 while in full-draw. A sliding sight arm 40, having a pivotal angled end 41 and an unsecured end 42 is disposed near the pivotal end 21 of the adjustment lever 20 in sliding relation to a sight arm clamp 44. The sliding sight arm 40 capable of longitudinal sliding adjustments along its length from the pivotal angled end 41 to the unsecured end 42 within the sight arm clamp 44. The pivotal angled end 41 is pivotally connected to the sight plate 60 by a fourth pivotal connection 43 at the lower end 62. The sliding sight arm 40 and the sight stabilizer rod 30 are held parallel to one another with their sliding relationship independent of one another to allow the sight arm plate 60 to be angled as shown in FIG. 3.

Lateral projections 66 on the sight plate 60 at the upper end 61 and the lower end 63 contain a vertical adjustment means 65 consisting of a threaded screw which is vertically affixed within the lateral projections 66 and held parallel to the vertical sight plate 61. A sight mount with securing means 64 containing a complimentary helix is disposed on the vertical adjustment means 65 and is capable of vertical movement about the vertical adjustment means 65 as it is turned. A vertical aperture 63 within the sight plate 60 allows the sight mount with securing means 64 to connect a standard sighting means 81 on the side opposite the lateral projections 66 and move the affixed standard sighting means 81 in tandem with the sight mount with securing means 64 along the vertical aperture 63.

As constructed, force applied at the translational end 22 of the adjustment lever 20 will result in respective vertically arced displacement of the sight stabilizer rod 30 at the pivotal end 31 and the sliding sight arm 40 at the pivotal angled end 41 allowing the sight plate 60 and constituent components to move about the vertical arc. In addition the detailed description, it should be appreciated by one skilled in the art that the construction of this invention with respect to the sides on which each component is disposed can be reversed to allow for a left-handed perspective.

The invention claimed is:

1. A calibrated archery bow sight, comprising:

a mounting bracket having a mounting end, an upper projection, a lower curved projection and a lower curved projection end, said mounting end capable of being secured to a bow;

a substantially vertical adjustment lever having a translational end and a pivotal end, pivotally connected to said mounting bracket a sight stabilizer rod having an unsecured end and a pivotal end, pivotally connected in a sliding relation to said upper projection of said mounting bracket;

a sliding sight arm, having a pivotal angled end and a unsecured end, slideably coupled to said adjustment lever;

a sight plate having an upper end and a lower end, said pivotal angled end of said sliding sight arm pivotally connected to said lower end of said sight plate and said pivotal end of said sight stabilizer rod secured to said upper end of said sight plate;

a calibrated range dial disposed between said lower curved projection and said lower curved projection end of said mounting bracket rotatably affixed to the adjustment lever.

2. A calibrated archery bow sight of claim 1, in which the sliding relationship between said sight stabilizer rod and said sliding sight arm, control the angular positioning of the said sight plate.

3. A calibrated archery bow sight of claim 1, in which said calibrated range dial can be permanently marked or etched along the circumference negating the need for subsequent scales or tapes.

4. A calibrated archery bow sight of claim 1, in which a vertical indentation is disposed on the translational end of the adjustment lever allowing multi-direction tactile displacement of the adjustment lever.

5. A method for sighting in the calibrated archery bow sight of claim 1 including;

setting said calibrated range dial to the twenty yard setting using a twenty yard archery target;

sighting in multiple arrows at the twenty yard target while placing said sight mount and securing means in the desired vertical location about the sight plate;

setting the calibrated range dial to the forty yard setting for a forty yard archery target;

sighting in multiple arrows at the forty yard target while making adjustments to the sliding sight arm to place the sight plate in the desired location to obtain the forty yard target;

bringing the arrow to full draw and placing finger(s) of the bow hand into the vertical indentation of the adjustment lever to select subsequent yardages on the calibrated range dial as indicated by the dial index pin to accurately hit targets ranging from ten to one hundred yards.

* * * * *